US007635093B2

(12) United States Patent
Stier

(10) Patent No.: US 7,635,093 B2
(45) Date of Patent: Dec. 22, 2009

(54) FUEL INJECTION VALVE

(75) Inventor: Hubert Stier, Vaihingen/Enz (DE)

(73) Assignee: Robert Bosch GmbH, Stuttgart (DE)

( * ) Notice: Subject to any disclaimer, the term of this patent is extended or adjusted under 35 U.S.C. 154(b) by 149 days.

(21) Appl. No.: 10/547,962

(22) PCT Filed: Jan. 23, 2004

(86) PCT No.: PCT/DE2004/000098

§ 371 (c)(1),
(2), (4) Date: Sep. 6, 2005

(87) PCT Pub. No.: WO2004/081367

PCT Pub. Date: Sep. 23, 2004

(65) Prior Publication Data

US 2006/0175438 A1 Aug. 10, 2006

(30) Foreign Application Priority Data

Mar. 12, 2003 (DE) ..... 103 10 790

(51) Int. Cl.
*B05B 1/08* (2006.01)

(52) U.S. Cl. ..... 239/102.2; 239/456; 239/584

(58) Field of Classification Search ..... 239/102.2, 239/102.1, 456–460, 584–586
See application file for complete search history.

(56) References Cited

U.S. PATENT DOCUMENTS

| | | | | |
|---|---|---|---|---|
| 4,915,350 | A | 4/1990 | Babitzka et al. | |
| 6,302,333 | B1 * | 10/2001 | Hoffmann et al. | 239/88 |
| 6,390,385 | B1 * | 5/2002 | Hardy et al. | 239/102.2 |

FOREIGN PATENT DOCUMENTS

| | | |
|---|---|---|
| CN | 1041211 | 4/1990 |
| DE | 35 33 085 | 3/1987 |
| DE | 195 00 706 | 7/1996 |
| DE | 199 42 816 | 3/2001 |
| DE | 199 50 760 | 4/2001 |
| DE | 199 63 568 | 7/2001 |
| DE | 101 49 052 | 7/2002 |
| DE | 101 33 265 | 1/2003 |
| EP | 0 967 386 | 12/1999 |
| EP | 0 995 901 | 4/2000 |
| EP | 1 096 136 | 5/2001 |
| JP | 1312283 | 12/1989 |
| JP | 6267276 | 9/1994 |
| JP | 8233141 | 9/1996 |
| JP | 10205406 | 8/1998 |
| JP | 11351098 | 12/1999 |
| JP | 2000130285 | 5/2000 |
| JP | 2002115617 | 4/2002 |
| JP | 2002202028 | 7/2002 |

(Continued)

*Primary Examiner*—Christopher S Kim
(74) *Attorney, Agent, or Firm*—Kenyon & Kenyon LLP

(57) ABSTRACT

A fuel injector, in particular a fuel injector for fuel-injection systems of internal combustion engines, includes a piezoelectric or magnetostrictive actuator which is excitable via an electrical line and actuates a valve-closure member arranged in a housing, the valve-closure member cooperating with a valve-seat surface to form a sealing seat, and an hydraulic coupler. The hydraulic coupler is fixedly arranged between the actuator and a valve-assembly that includes the valve-closure member and the valve-seat surface.

7 Claims, 3 Drawing Sheets

FOREIGN PATENT DOCUMENTS

| | | | |
|---|---|---|---|
| WO | WO00/17509 | * | 3/2000 |
| WO | 01/20401 | | 3/2001 |
| WO | 01/29403 | | 4/2001 |
| WO | WO 03/006820 | | 1/2003 |
| WO | 03/016707 | | 2/2003 |

* cited by examiner

FUEL INJECTION VALVE

BACKGROUND INFORMATION

German Patent Application No. DE 35 33 085 describes a metering valve for the metering of fluids or gases, especially an injection valve for fuel-injection systems in internal combustion engines, which includes a piezo stack actuator whose linear deformation in response to the application of an excitation voltage is transmitted to a valve needle which controls a metering orifice and determines the valve lift of the valve needle. The substance to be metered is supplied via a supply line which is designed in the form of a deep-hole bore in the valve body.

Disadvantageous in the metering valve described in German Patent Application No. DE 35 33 085 is the floating suspension of the hydraulic coupler between fuel intake and actuator, which exposes the coupler to fluctuations in the fuel pressure. The electrical lines required for the contacting of the actuator must be run in a complicated manner to prevent tensile stressing due to the positional changes. Furthermore, the lines have to be installed around the coupler, which makes them both longer and also increases the installation space. The valve housing becomes bulky as a result and in turn requires larger installation space in the cylinder head.

SUMMARY OF THE INVENTION

The fuel injector according to the present invention has the advantage that the hydraulic coupler is fixedly arranged between the actuator and a valve assembly, so that the electrical contacting of the actuator will not have to take place around the actuator, and linear deformations caused by positional changes of the coupler are omitted.

The actuator is advantageously fixedly connected to the valve housing, thereby achieving a stationary relative position of the actuator with respect to the housing.

Furthermore, it is advantageous that the electrical lines run through bores in an actuator foot and are fixed and protected by a plastic extrusion coat.

The plug in which the electrical lines are arranged is advantageously premolded on the plastic extrusion coat.

In an advantageous manner, the coupler acts on the valve needle via a calotte, so that offsets are able to be compensated.

DETAILED DESCRIPTION

Figure 1:
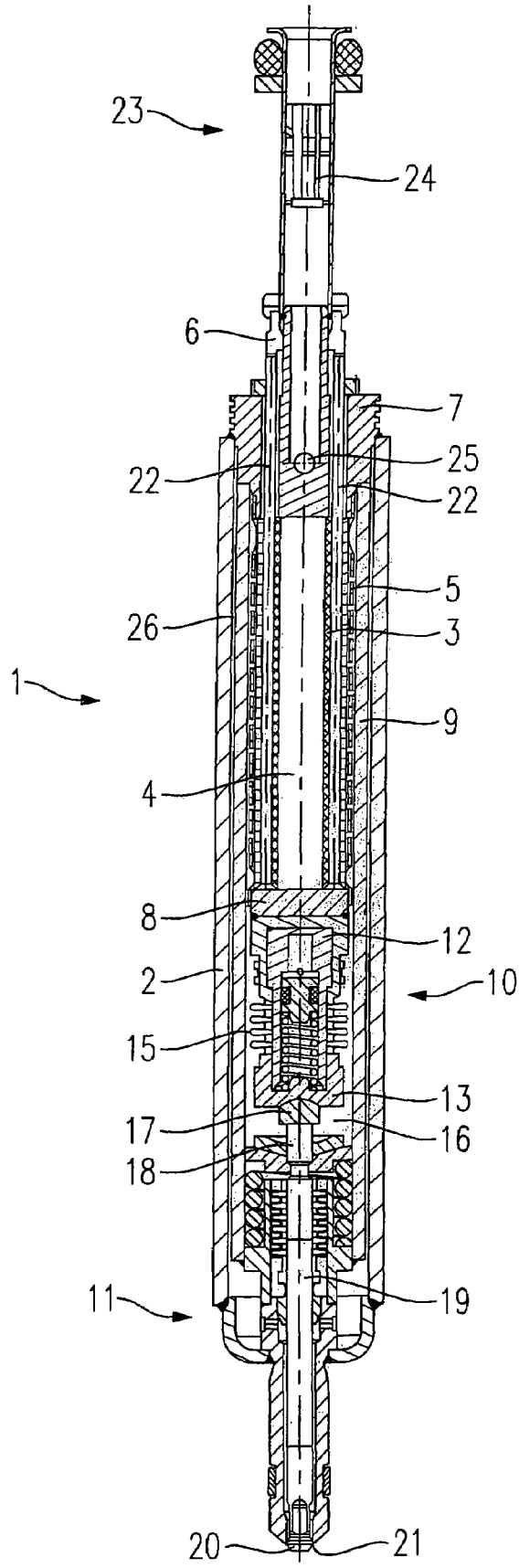
FIG. 1 shows a schematic section through an exemplary embodiment of a fuel injector configured according to the present invention, along a first sectional plane.

In the following, a preferred exemplary embodiment of the present invention is described by way of example. In this context, corresponding components are provided with the same reference numerals in all of the figures.

Figure 2:
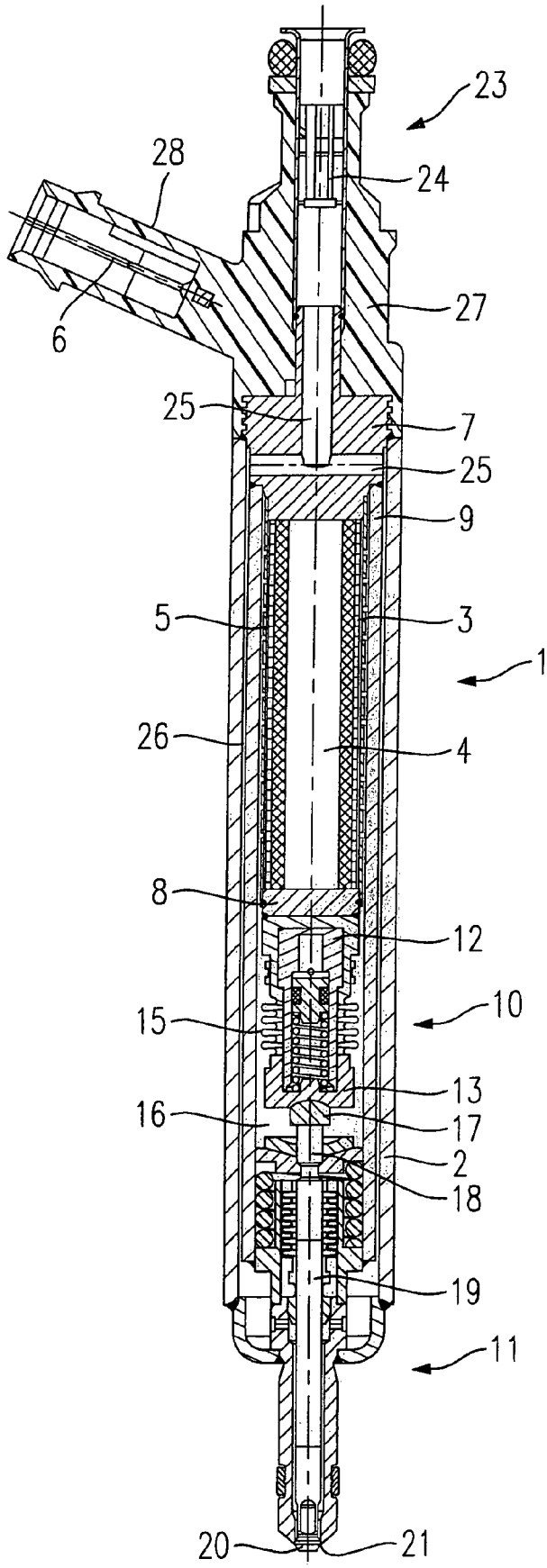
FIG. 2 shows a schematic section through the exemplary embodiment of a fuel injector configured according to the present invention, shown in FIG. 1, along a second sectional plane.

A fuel injector 1 shown in FIGS. 1 and 2 in two mutually perpendicular sectional views along a longitudinal axis is designed in the form of a fuel injector 1 for fuel-injection systems of mixture-compressing internal combustion engines having externally supplied ignition. Fuel injector 1 is particularly suited for the direct injection of fuel into a combustion chamber (not shown) of an internal combustion engine.

Fuel injector 1 includes a housing 2 in which a piezoelectric or magnetostrictive actuator 4 provided with an actuator extrusion coat 3 is arranged. Actuator 4 is prestressed by a tubular spring 5 to allow a non-destructive installation and a reproducible actuation of actuator 4. An electrical voltage may be supplied to actuator 4 via an electrical line 6. On the inflow side, actuator 4 is braced on an actuator foot 7, and on the downstream side it is braced on an actuator head 8. Actuator 4 is encapsulated in a valve housing 9.

According to the present invention, fuel injector 1 has an hydraulic coupler 10 on the downstream side of actuator 4, which is supported between actuator 4 and a valve module 11 without pressure. Hydraulic coupler 10 is configured as secondary medium coupler 10 and includes a master piston 12 and a slave piston 13, which are mutually acted upon by a coupler spring 14. Hydraulic coupler 10 is sealed from an interior 16 of fuel injector 1 by a corrugated-tube-shaped seal 15, for example.

Slave piston 13 of hydraulic coupler 10 rests against a calotte 17 that cooperates with a valve needle 19 via an actuating element 18. Calotte 17 compensates offsets of valve needle 19 during operation of fuel injector 1. At its downstream-side end, valve needle 19 has a valve-closure member 20 which cooperates with a valve-seat surface 21 to form a sealing seat. Shown in the exemplary embodiment is an outwardly opening fuel injector 1.

Due to the fact that actuator 4 is not floatingly but fixedly suspended, a fixed thermal connection of actuator 4 to housing 2 is able to be achieved, so that a gap between actuator 4 and housing 2 may be omitted. Because of improved heat dissipation, the temperature of actuator 4 is able to be lowered. In addition, movable cable routings between actuator 4 and electrical plug-in contact 6 along coupler 10 may be dispensed with as a result of the fixed suspension of actuator 2.

Electrical line 6 penetrates actuator foot 7 through bores 22 that are formed in actuator foot 7. Since hydraulic coupler 10 is arranged downstream from actuator 4, shorter electrical lines 6 may be run without movement-compensating cable runs along actuator 4. Valve housing 2 may be slimmer as a result since electrical lines 6 need not be guided around hydraulic coupler 10.

The fuel is supplied via a central intake nipple 23 in which a filter 24 may be arranged. The fuel is guided to the sealing seat via bores 25 and a gap 26 formed between actuator housing 9 and valve housing 2. In FIG. 2, intake nipple 23 has been provided with a plastic extrusion coat 27 on which a plug 28 for electrical lines 6 has been premolded.

Figure 3A:
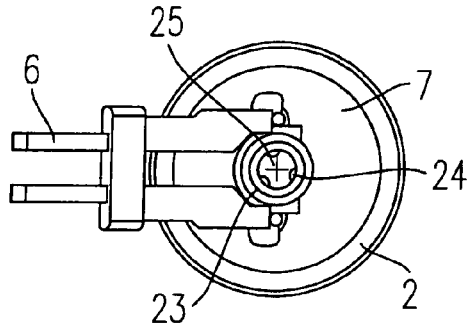
FIGS. 3A and 3B show the plug-in contact of the fuel injector configured according to the present invention, with and without plastic extrusion coat.
Figure 3B:
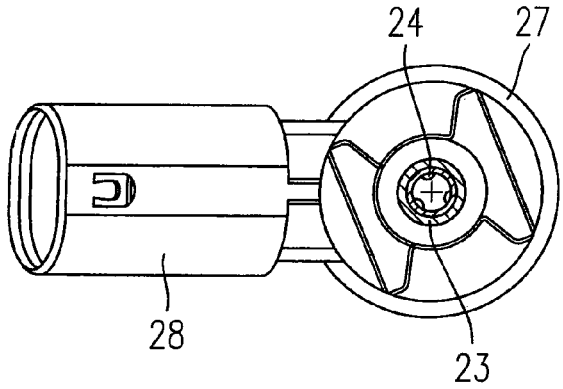

FIGS. 3A and 3B show detail views of plug 28 in a plan view of fuel injector 1 in the discharge direction of the fuel.

In FIG. 3A, fuel injector 1 is shown as in FIG. 1 without plastic extrusion coat 27. Electrical lines 6 are guided into actuator foot 7 in a direct and straight manner and extend in parallel to bore 25 through which the fuel is guided from intake nipple 23.

FIG. 3B shows plug 28 in the same view, after intake nipple 23 has been provided with an extrusion coat made of plastic 27. Plastic extrusion coat 27 and plug 28 are able to be produced in one method step in a simple and cost-effective manner. Plastic extrusion coat 27 fixes electrical lines 6 at intake nipple 23 and at actuator foot 7 and protects them from damage.

As can already be gathered from FIGS. 1 and 2, coupler 10 is supported between actuator head 8 and valve needle 19 by a calotte 17 in a tiltable manner. In FIGS. 1 and 2, calotte 17 is arranged between hydraulic coupler 10 and an actuating element 18, which is in operative connection with valve needle 19.

Figure 4:
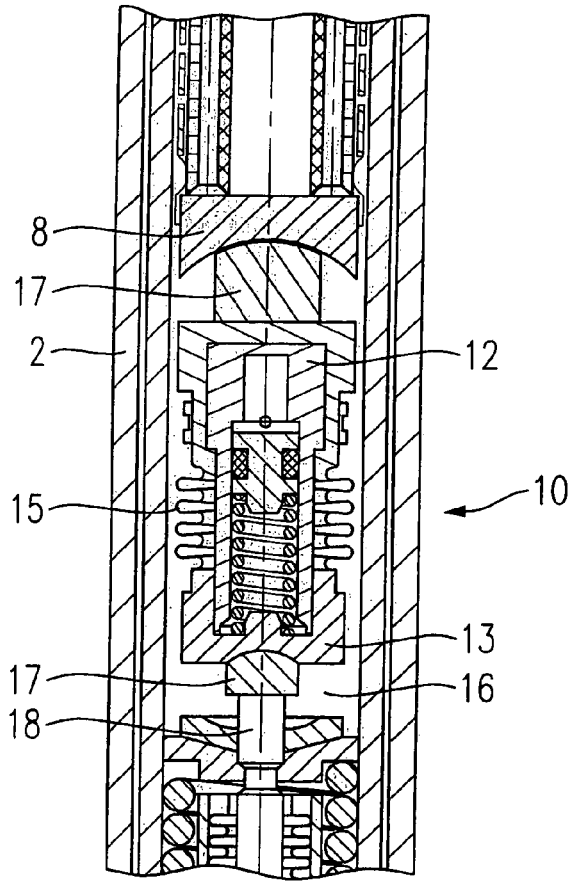
FIG. 4 shows a cutaway view of the tiltable suspension of the coupler between actuator and valve needle of the fuel injector configured according to the present invention as shown in FIGS. 1 and 2.

FIG. 4 illustrates another possibility of arranging calotte 17 between hydraulic coupler 10 and actuator head 8. Both possibilities allow the compensation of offsets of valve needle 19 during operation of fuel injector 1, which would otherwise lead to malfunctions of fuel injector 1 due to jamming of valve needle 19 or result in destruction of actuator 4 because of shear forces in offsets.

The present invention is not restricted to the exemplary embodiment shown but suitable for various designs of fuel injectors 1.

What is claimed is:

1. A fuel injector comprising:

a housing;

a valve needle having a valve-closure member that is situated in the housing;

one of a piezoelectric and magnetostrictive actuator, excitable via at least one electrical line, for actuating the valve-closure member;

a valve-seat surface, the valve-closure member cooperating with the valve-seat surface to form a sealing seat; and a hydraulic coupler including a master piston and a slave piston and fixedly situated between the actuator and a valve-subassembly which includes the valve needle, the valve-closure member and the valve-seat surface;

wherein the actuator is braced on an actuator foot via an inflow-side end, the actuator foot is rigidly connected to the housing, and the actuator is braced on an actuator head via a discharge-side end;

wherein the hydraulic coupler is supported on the valve needle so as to be pivotable, using a calotte, the calotte being operatively connected to the valve needle via an actuating element and engaging with a depression in the slave piston.

2. The fuel injector according to claim 1, wherein at least one axial bore is situated in the actuator foot.

3. The fuel injector according to claim 2, wherein the electrical line is situated in the at least one axial bore.

4. The fuel injector according to claim 1, wherein the fuel injector has a plastic extrusion coat on an intake-side end.

5. The fuel injector according to claim 4, further comprising a plug premolded on the plastic extrusion coat.

6. The fuel injector according to claim 5, wherein the electrical line ends in the plug.

7. The fuel injector according to claim 6, wherein the electrical line extends in a paraxial manner with respect to a longitudinal axis of the fuel injector and the actuator.

* * * * *